United States Patent [19]

Schulz et al.

[11] 4,176,309

[45] Nov. 27, 1979

[54] STABILIZED VOLTAGE REGULATOR CIRCUIT, PARTICULARLY FOR USE WITH A SERIALLY CONNECTED PNP TRANSISTOR

[75] Inventors: Alfred Schulz, Oberriexingen; Uwe Kiencke, Ludwigsburg; Günther Hönig, Markgröningen, all of Fed. Rep. of Germany

[73] Assignee: Robert Bosch GmbH, Stuttgart, Fed. Rep. of Germany

[21] Appl. No.: 890,416

[22] Filed: Mar. 27, 1978

[30] Foreign Application Priority Data

Apr. 14, 1977 [DE] Fed. Rep. of Germany ..... 2716500

[51] Int. Cl.[2] ..... G05F 1/56

[52] U.S. Cl. ..... 323/4; 323/20; 323/22 T

[58] Field of Search ..... 323/4, 20, 22 T, DIG. 1

[56] References Cited

U.S. PATENT DOCUMENTS

| | | | |
|---|---|---|---|
| 3,548,291 | 12/1970 | Heaslett | 323/22 T |
| 3,585,491 | 6/1971 | Petersen | 323/DIG. 1 |
| 3,986,100 | 10/1976 | Beierholm et al. | 323/17 |
| 4,025,843 | 5/1977 | Parker | 323/22 T |
| 4,055,794 | 10/1977 | Ickes | 323/22 T |
| 4,079,445 | 3/1978 | Hufnagel | 323/22 T |

*Primary Examiner*—A. D. Pellinen

*Attorney, Agent, or Firm*—Frishauf, Holtz, Goodman & Woodward

[57] ABSTRACT

To permit low differences between regulated output voltage and unregulated input voltage, for example in the order of only 200mV, a control loop formed of a serially connected PNP transistor 11, a reference voltage generator 15, a voltage divider 13 connected across the regulated output, and a comparator-amplifier 14 comparing the output taken from the voltage divider 13 and the reference and providing an error control signal has a second control loop connected thereto which includes a transistor and a current sensing resistor connected to the base of the control transistor 11 and a second comparator comparing the actual current flow through the transistor 18 and the error signal to stabilize the control transistor. A switching network 16 can be additionally connected to modify or affect the error signal applied to the second control loop.

11 Claims, 1 Drawing Figure

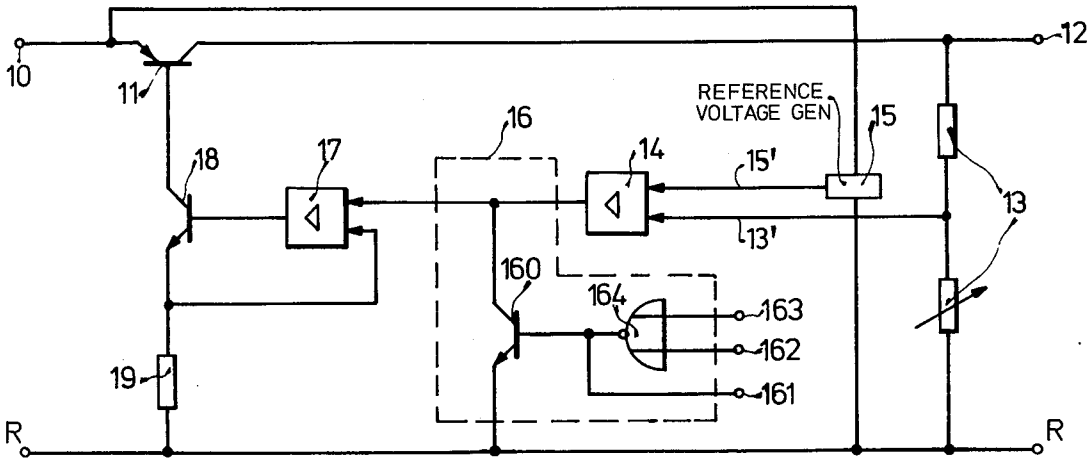
12
13
15
REFERENCE VOLTAGE GEN
15'
13'
14
16
17
18
11
10
19
R
R
163
162
161
164
160

STABILIZED VOLTAGE REGULATOR CIRCUIT, PARTICULARLY FOR USE WITH A SERIALLY CONNECTED PNP TRANSISTOR

REFERENCE TO RELATED PUBLICATIONS (1) "Electronics", vol. 35, No. 44, 1962, pages 48–50.

(2) "Electronics", vol. 38, .No. 23, 1965, pages 109–110.

(3) U.S. application Ser. No. 660,858 of Feb. 24, 1976, Mayer, now U.S. Pat. No. 4,082,069, assigned to the assignee of the present invention.

The present invention relates to a voltage regulator and more particularly to a solid state voltage regulator circuit which has fast response time.

BACKGROUND AND PRIOR ART

Various types of voltage regulator circuits using transistors as a variable resistance element have been proposed. One such voltage regulator circuit is described in the publication "Electronics", vol. 35, Nr. 44, 1962, pages 48–50 which disclose a voltage regulator with a NPN control transistor; and "Electronics", vol. 38, Nr. 23, 1965, pages 109–110, illustrating a voltage regulator with a PNP transistor.

NPN transistors have a saturation voltage of about 1V. In order to be able to obtain regulated output voltages even though the input voltage is only slightly above the desired, regulated output voltage, for example to obtain a regulated output voltage of 5 V even if the input has dropped to 5.5 V, it is necessary to use PNP transistors which have saturation voltages which can be as low as 200 mV, depending on the type of transistor being used. PNP transistors connected in voltage regulator circuits have the tendency to oscillate, which makes the circuit unstable and thus inhibits use of PNP transistors in voltage regulated circuits in many applications where stability is of primary importance. One such application, for example, is to provide a regulated output voltage for calculating or computer-type circuits, for example, micro-processor circuits in automotive vehicles, in which the supply voltage can vary widely. A typical application is, for example, the type of computer described in U.S. application Ser. No. 660,858, filed Feb. 24, 1976, Mayer, now U.S. Pat. No. 4,082,069 assigned to the assignee of the present application.

THE INVENTION

It is an object to provide a voltage regulator circuit which is stable and permits the use of a PNP transistor as a variable resistance in a series circuit between input and output of the regulator.

Briefly, the voltage regulator circuit includes a control loop in which a control signal is derived as a function of the difference between the output signal and a reference; a second control loop is then connected between the output of the comparator, providing the first error signal and the control transistor, the output of the comparator (that is, the error signal) forming a command signal for the second control loop. The second control loop, preferably, has a control time constant which is shorter than the control time constant of the control loop formed by the comparator-control amplifier and deriving the first control signal. The second control loop, in accordance with the preferred embodiment, is a current control loop for the base current of the control transistor, serially connected in the voltage regulator circuit.

The system of voltage regulation in which two control loops are used, one within the other, has the advantage that the second control loop insures stability even if the control transistor is a PNP transistor. Differences in the characteristics of individual circuit components, which may arise, for example, by integration of the circuit elements in an integrated circuit are substantially reduced in their effects on the eventual operation of the overall system. The input voltage of the stabilization circuit need be only about 200 mV above the desired output voltage. If the load changes, the output voltage follows the load change rapidly to control output load voltage to the desired level. The entire circuit can be integrated on a single chip except for the PNP power transistor which may have to be a separate element if the circuit is designed for high current drain.

Use of the second control loop connected as a current control circuit for the base current of the main control transistor insures rapid reaction to any dangers in output loading without oscillations, or hunting of the output voltage.

The circuit also permits control of the output voltage by external control signals by introducting external control signals to the error signal derived from the first control loop. This external control of the output voltage permits versatile application of the voltage regulator circuits, particularly where constructed as an integrated circuit unit.

DRAWINGS, ILLUSTRATING A PREFERRED EMBODIMENT

This single FIGURE is a schematic circuit diagram, partly in block circuit form.

The input terminals 10, R, have a voltage applied therebetween. Terminal 10 is connected to the emitter-collector path of a PNP transistor 11, the output of which is connected to the output terminal 12. An adjustable voltage divider 13 is connected across the output terminals 12, R. The output voltage, which is the controlled voltage is taken from a tap point of the voltage divider 13. The input terminal 10 is additionally connected to a reference voltage generating unit 15, the input terminal supplying power thereto. Unit 15 may, for example, be a Zener diode, or a Zener diode-resistance network. The reference voltage available at bus 15' and the output voltage, as divided by the voltage divider 13 and available at bus 13' are compared in a comparator-amplifier 14 which, for example, can be an operational amplifier. The command input is available at bus 15'; the actual voltage input is available at bus 13'. This part of the circuit is standard, and as disclosed in the aforementioned reference publications. The output of amplifier 14 is connected through a network 16 with the command input of a second control amplifier 17 which, again, can be an operational amplifier. The output of the amplifier 17 is connected to the base of a NPN transistor 18, the collector-emitter path of which is connected to the base of the power control transistor 11 and through a current sensing resistor 19 to the reference terminal R. The emitter of the transistor 18 is connected additionally to the actual control current input of the comparator amplifier 17.

The outer or first control loop is formed by the elements 11, 13, 14, 15; in accordance with the invention, a second or inner control loop formed of elements 17, 18, 19, is additionally provided.

The network 16 includes a transistor 160, the collector-emitter path of which is connected between the output of amplifier 14, and hence the command input to amplifier 17 and ground or reference or chassis terminal R. The control input of transistor 160 is connected to a plurality of input terminals 161, 162, 163, the latter two terminals 162, 163 being connected through a NOR gate 164. External control signals 2 can be applied to the terminals 161, 162, 163, respectively, to modulate, or affect the command current connected to the comparator amplifier 17 which, also, forms the error current, or error signal derived from comparator-amplifier 14.

OPERATION

The inner or second control loop 17, 18, 19 controls the base current of transistor 11 by varying the respective resistance of the transistor 18. The resistor 19 measures the actual current flowing to the base of transistor 11 and compares this current to a command input value at the other input to the comparator-amplifier 17. This command input value is the error signal derived from the output of the comparator-amplifier 14 which, in turn, is the error due to the difference of output voltage, as determined by the voltage at the tap point of the voltage divider 13 and the voltage at the reference voltage generator 15. The voltage divider 13 preferably includes an adjustable resistance element to permit variable adjustment of the output voltage with a constant reference voltage derived from the reference voltage generator or source 15. Let it be assumed that the voltage at input terminal 10 changes suddenly. This voltage rise will be transferred through the emitter-collector path of transistor 11. Since the second control current 17, 18, 19 tends to maintain the base current, the output voltage will remain at the command value as determined by the relative value as set by the voltage divider 13 and the reference voltage source or generator 15.

If a signal is applied to terminal 161, transistor 160 will become conductive and the command current applied to comparator amplifier 17 will be zero. Consequently, the transistor 18 will be commanded to block and the output voltage 12 will drop to zero. This, in effect, disconnects the output from the input. If the stabilized voltage is used as a supply voltage for the aforementioned calculasystem of U.S. Ser. No. 660,858, now patent then, preferably, a switching output of the system as well as the ignition switch of the vehicle to which the system is connected can be, respectively, connected over the NOR gate 164. If the ignition switch is opened, stabilized voltage can continue to be supplied to the computation system because the voltage stabilization is maintained through the NOR gate from an output of the computational system. This is desirable if, for example, the vehicle is intended to be started but does not start immediately; in case of repeated start attempts, the computational system will continue to have regulated voltage applied thereto which is desirable because the necessary initial quantity of fuel to be injected, in accordance with the computation of the computational system will be appropriately calculated because the basis for the calculation will be a regulated voltage as applied by the system in accordance with the present application.

The network 15 can be connected also to other lines or buses than those shown in the drawing; for example, the network 16 can be connected to bus 15', or to modify the reference voltage level of the reference voltage generator 15.

Various changes and modifications may be made within the scope of the inventive concept.

We claim:

1. Direct current voltage regulator circuit adapted for connection to unregulated input terminals (10,R) and provide a regulated output voltage at output terminals (12,R) having a control transistor (11), serially connected between an input terminal (10) and an output terminal (12);

reference voltage generating means (15) generating a reference voltage;

a first control loop (13, 14, 15) comprising a comparator-control amplifier (14) having said reference voltage applied thereto and additionally connected to a voltage representative of the actual output voltage and generating a control error signal to control the conduction of said control transistor (11), and a second control loop (17, 18, 19) comprising means (19) deriving a signal representative of actual base current flow in the control transistor (11);

a second comparator (17) having said control error signal applied thereto and additionally connected to the signal representative of actual base current of the control transistor, and connected to and controlling the flow of base current of the control transistor (11).

2. Circuit according to claim 1 wherein the second control loop comprises a transistor (18) connected to control the base current to the control transistor (11);

the base current signal deriving means comprises a current sensor (19) connected to have the current flowing to the base of the control transistor (11) flowing therethrough;

and the comparator (17) is connected to receive the base current signal representative of the current flowing through the current sensing element (19) and said control error signal derived from the output of the comparator-control amplifier, the output of said comparator (17) controlling the conductivity of said transistor (18).

3. Circuit according to claim 2 wherein the control transistor (11) is a PNP transistor;

and the second control loop has a control time constant which is shorter than the control time constant of the first control loop formed by said comparator-control amplifier (14), the PNP control transistor (11) and the reference voltage generating means (15).

4. Circuit according to claim 2, further including a switching network (16) connected to affect a voltage appearing in the first control loop.

5. Circuit according to claim 4 wherein the switching network includes a switch (160) connected to control the control, or error signal being applied to the second control loop to be close to, or effectively null or zero.

6. Circuit according to claim 5 wherein the switching network includes a logic circuit (164) to permit logical application of external control signals thereto.

7. Circuit according to claim 1 further including a switching network (16) connected to affect a voltage appearing in the first control loop.

8. Circuit according to claim 7 wherein the switching network (16) is connected to affect the control error signal applied by said comparator-control amplifier (14) to the second control loop.

9. Circuit according to claim 8, wherein the control transistor (11) is a PNP transistor;

and the second control loop has a control time constant which is shorter than the control time constant of the first control loop formed by said comparator-control amplifier (14), the PNP control transistor (11) and the reference voltage generating means (15).

10. Circuit according to claim 1 wherein said second control loop has a time constant which is shorter than the time constant of the first control loop formed by said comparator-control amplifier (14), the control transistor (11) and said reference voltage generating means (15).

11. Circuit according to claim 1 wherein the control transistor (11) is a PNP transistor.

* * * * *